United States Patent [19]

Bieniok et al.

[11] 4,115,986

[45] Sep. 26, 1978

[54] TWIST TUBE FOR FALSE-TWIST DEVICES

[75] Inventors: Joachim Bieniok, Wattwil, Switzerland; Henri Crouzet, Roanne, France

[73] Assignees: Heberlein & Co. AG, Switzerland; Ateliers Roannais de Constructions Textiles, France

[21] Appl. No.: 551,985

[22] Filed: Feb. 21, 1975

[30] Foreign Application Priority Data

Apr. 5, 1974 [CH] Switzerland ..... 4834/74

[51] Int. Cl.[2] ..... D01H 7/92; D02G 1/06

[52] U.S. Cl. ..... 57/77.3; 57/77.33

[58] Field of Search ..... 57/77.3, 77.33, 77.35, 57/77.37

[56] References Cited

U.S. PATENT DOCUMENTS

| | | | |
|---|---|---|---|
| 2,463,619 | 3/1949 | Kumzle | 57/77.3 |
| 2,655,781 | 10/1953 | Heberlein et al. | 57/77.3 |
| 2,863,277 | 12/1958 | Boillat et al. | 57/77.3 |
| 3,090,190 | 5/1963 | Boussu et al. | 57/77.3 X |
| 3,475,895 | 11/1969 | Raschle | 57/77.3 |
| 3,778,991 | 12/1973 | Brummer | 57/77.3 |
| 3,842,581 | 10/1974 | Schedler | 57/77.3 |

FOREIGN PATENT DOCUMENTS

| | | | |
|---|---|---|---|
| 1,477,791 | 4/1967 | France | 57/77.3 |
| 528,055 | 12/1955 | Italy | 57/77.3 |

*Primary Examiner*—Charles Gorenstein

*Attorney, Agent, or Firm*—Larson, Taylor and Hinds

[57] ABSTRACT

A twist tube for a false twist device is described which is of the type wherein textile yarn being textured passes through a straight tubular part to a transverse pin of hard material round which the yarn is wound once prior to leaving the tube. To avoid ballooning at very high rotational speeds of the twist tube about its axis, the pin is fixed in the tubular part with its axis displaced laterally with respect to the tube axis by a distance which is a fraction of the pin diameter. Between its cylindrical ends the pin is formed with a cylindrical concave surface providing a gap with respect to the tube axis of a width of the order of half the yarn thickness. To aid threading, openings are provided on opposite sides of the tubular part and the one nearest the laterally displaced pin is enlarged to balance the twist tube about its axis.

1 Claim, 3 Drawing Figures

TWIST TUBE FOR FALSE-TWIST DEVICES

FIELD OF THE INVENTION

The present invention relates to twist tubes for false-twist devices for texturing textile yarns.

The development of false-twist devices for texturing textile yarns is leading to the use of higher and higher revolution speeds for the twist tube so as to increase the yarn delivery speed and therefore the rate of production of textured yarns. False-twist devices are already known in which twist tube revolution speeds of several hundred thousand r.p.m. can be achieved.

DESCRIPTION OF THE PRIOR ART

Twist tubes for such false-twist devices are known in the interior of which there is arranged a diametrically extending pin of hard material, for example sapphire or ceramic material. The yarn to be textured which passes through the longitudinal bore of the twist tube, is wound once around the pin.

Such twist tubes are highly suitable for texturing relatively thin textile yarns at the twist tube revolution speeds usual up to now. If the twist tube revolution speed is, however, increased substantially and especially when texturing relatively coarse textile yarns, the known twist tubes are no longer satisfactory. Since the textile yarn reaches the pin excentrically, it has a strong tendency to balloon, and this tendency increases with coarser textile yarns and higher twist tube revolution speeds. When a balloon is formed, under the influence of the centrifugal forces acting on the textile yarn, an additional yarn tension appears which can become so high that yarn breakages occur.

SUMMARY OF THE INVENTION

It is the purpose of the present invention to eliminate this disadvantage and to provide a twist tube by means of which the ballooning is essentially reduced even at extremely high twist tube revolution speeds and when treating relatively coarse textile yarns so that the risk of yarn breakages is eliminated or at least considerably reduced.

Accordingly, the object of the present invention consists in a twist tube comprising a transverse pin provided in the interior thereof which is displaced laterally by a fraction of its thickness with respect to the central axis of the twist tube. Thereby, it is achieved that the textile yarns pass exactly through the central longitudinal axis of the twist tube, thus effectively reducing the ballooning tendency.

DESCRIPTION OF THE DRAWINGS

In order that the invention may be clearly understood and readily carried into effect, a twist tube in accordance therewith will now be described, by way of example with reference to the accompanying drawings, in which.

Figure 1:
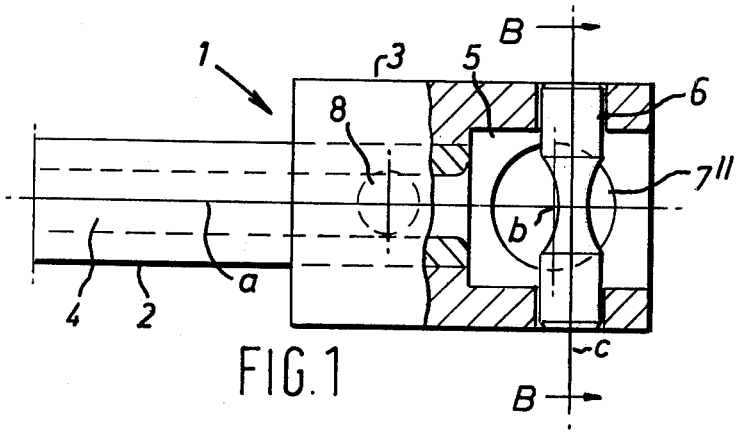
FIG. 1 shows the terminal portion of a twist tube, partially in section, the section being taken on the line A—A in FIG. 2.

The terminal portion 1 of the twist tube shown in FIG. 1 consists of a straight tubular part 2 and a coaxial head 3 of larger diameter than that of tubular part 2. The tubular part 2 has a longitudinal bore 4 which passes into an enlarged longitudinal bore 5 of head 3. In the longitudinal bore 5, there is arranged a pin 6 which consists of sapphire and the diameter of which is approximately 1 millimetre at both ends and approximately 0.7 millimetre at the centre of a central thinner portion constituted by a cylindrical concave portion symmetrically located between cylindrical ends of the pin that are fixed in opposed wall parts of head 3.

Figure 2:
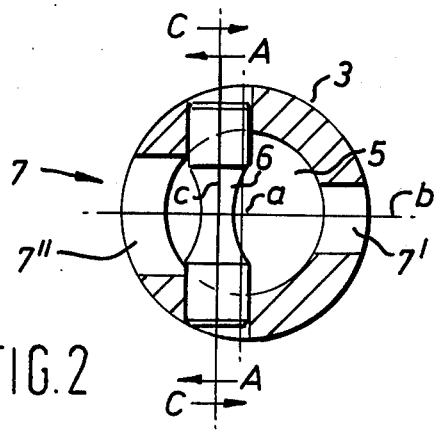
FIG. 2 shows a cross-section through the twist tube, the section being taken on line B—B in FIG. 1.

As shown in FIG. 2, the pin 6 is displaced laterally with respect to the central longitudinal axis *a* of the twist tube by approximately half its thickness so that the circumference of the thinner portion of pin 6 over which the textile yarn passes is displaced laterally so as to leave a gap between this circumference and the central longitudinal axis *a* of the twist tube which has a width of the order of half the yarn thickness (FIG. 2).

Figure 3:
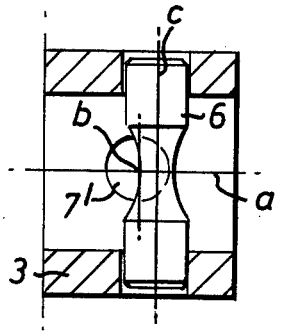
FIG. 3 shows a section on line C—C in FIG. 2.

As shown in FIGS. 1 to 3, the head 3 furthermore comprises a transverse bore 7 crossing the pin 6 and having an axis *b* (FIG. 3) displaced with respect to the axis *c* of the pin along the longitudinal axis *a* of the twist tube which facilitates threading of the yarn. In order to compensate for the excentricity caused by this arrangement of pin 6, the bore 7 has, in opposed wall parts of the head 3, openings of different diameters 7', 7''. In this case, the diameter of the opening 7'' on the side towards which the pin 6 is displaced is larger than the diameter of the opening 7' in the opposite wall portion by an amount that exactly balances the excentricity of the pin 6. It is of course also possible to achieve this excentricity compensation by means of other recesses in the material of the tube for example by a bore 8 indicated by a dotted line in FIG. 1 in the wall portion of head 3 towards which the pin 6 is displaced.

We claim:

1. A twist tube for a false twist device for texturing textile yarns comprising a tubular portion consisting of a straight tubular part and a coaxial tubular uniform head of larger diameter than that of said tubular part, said tubular part including a longitudinal bore that passes into an enlarged longitudinal bore in said head for the passage of textile yarn through said tubular portion when the twist tube is in operation, and a single cylindrical pin fixed in said head and extending through said enlarged head for the yarn to be wound once therearound prior to passing out of said enlarged head, said pin having uniform cylindrical ends with an intervening cylindrical concave surface symmetrically disposed between said ends and said pin being mounted in the wall of said head with its axis displaced laterally with respect to the axis of said head by a distance which is a fraction of the diameter of said cylindrical ends, and said head being formed with a transverse bore thereon having an axis perpendicular to that of said pin and constituted by openings in opposed wall parts of said head to aid the threading of yarn in the twist tube, the opening in the wall part towards which said pin is laterally displaced being larger than the other of said openings so as to compensate for lack of balance of the twist tube about the longitudinal axis thereof.

* * * * *